US008685332B2

(12) United States Patent
Seeley

(10) Patent No.: US 8,685,332 B2
(45) Date of Patent: Apr. 1, 2014

(54) APPARATUS AND METHOD FOR FORMING A PLASMA

(75) Inventor: Andrew James Seeley, Bristol (GB)

(73) Assignee: Edwards Limited, Crawley, West Sussex (GB)

( * ) Notice: Subject to any disclaimer, the term of this patent is extended or adjusted under 35 U.S.C. 154(b) by 2243 days.

(21) Appl. No.: 10/555,464

(22) PCT Filed: Apr. 16, 2004

(86) PCT No.: PCT/GB2004/001718

§ 371 (c)(1),
(2), (4) Date: Oct. 31, 2005

(87) PCT Pub. No.: WO2004/098246

PCT Pub. Date: Nov. 11, 2004

(65) Prior Publication Data

US 2006/0232214 A1 Oct. 19, 2006

(30) Foreign Application Priority Data

Apr. 30, 2003 (GB) ..... 0309932.2

(51) Int. Cl.
*B01J 19/08* (2006.01)

(52) U.S. Cl.
USPC ..... 422/186; 422/186.04

(58) Field of Classification Search
USPC ..... 422/186.04, 186; 204/164
See application file for complete search history.

(56) References Cited

U.S. PATENT DOCUMENTS

| | | | | |
|---|---|---|---|---|
| 4,282,267 | A | | 8/1981 | Kuyel |
| 4,818,560 | A | | 4/1989 | Ishihara et al. |
| 4,888,088 | A | | 12/1989 | Slomowitz |
| 5,273,587 | A | * | 12/1993 | Guha et al. ..... 118/723 MW |
| 5,418,430 | A | | 5/1995 | Bayliss |
| 5,503,807 | A | * | 4/1996 | Griffiths et al. ..... 422/186.04 |
| 6,558,635 | B2 | * | 5/2003 | Minaee et al. ..... 422/186 |
| 6,916,400 | B2 | * | 7/2005 | Moisan et al. ..... 156/345.41 |
| 2002/0101162 | A1 | | 8/2002 | Ikeda et al. |
| 2003/0000823 | A1 | | 1/2003 | Uhm et al. |
| 2003/0007910 | A1 | | 1/2003 | Lazarovich et al. |

FOREIGN PATENT DOCUMENTS

| | | | |
|---|---|---|---|
| EP | 0 200 499 | A1 | 12/1986 |
| EP | 0295083 | A2 | 12/1988 |
| EP | 0 665 306 | B1 | 10/2001 |
| GB | 2 064 856 | A | 6/1981 |

(Continued)

OTHER PUBLICATIONS

XP-002287306, Derwent Abstract of RU 1 568 805 C (as USSR Microeltrn Ultrapure CPDS Inst); V.V. Aristov, S.V. Redkin, N.S. Samsonov; Jul. 27, 1995.

(Continued)

*Primary Examiner* — Kishor Mayekar

(74) *Attorney, Agent, or Firm* — Westman, Champlin & Koehler, P.A.

(57) ABSTRACT

Apparatus is described for treating an effluent gas stream from a semiconductor manufacturing process tool. The apparatus comprises a plasma torch for generating a glow discharge from an inert, ionisable gas. The gas stream is conveyed to the glow discharge to ignite a plasma. A source of electromagnetic radiation supplies electromagnetic radiation to the effluent gas stream to sustain the plasma. The apparatus is particularly suitable for treating perfluorinated and hydroflurocarbon compounds in the effluent gas stream.

35 Claims, 3 Drawing Sheets

(56) References Cited

FOREIGN PATENT DOCUMENTS

| | | | |
|---|---|---|---|
| GB | 2273027 | A | 6/1994 |
| JP | 2001161855 | | 6/2001 |
| RU | 1568805 | C | 7/1995 |
| SU | 710113 | A | 1/1980 |
| TW | 509982 | B | 11/2002 |
| TW | 514700 | B | 12/2002 |
| TW | 523830 | B | 3/2003 |
| TW | 200845070 | A | 11/2008 |
| WO | WO 92/15184 | A1 | 9/1992 |
| WO | 01/39560 | A1 | 5/2001 |

OTHER PUBLICATIONS

United Kingdom Search Report of Application No. GB 0309932.2; Date of search: Nov. 26, 2003.

PCT International Search Report of International Application No. PCT/GB2004/001718; Date of mailing of the International Search Report: Jul. 15, 2004.

Prosecution history of corresponding European Patent Application No. 07003186.9 including: Written Opinion dated Apr. 22, 2010; Search Report dated Apr. 22, 2010; Response dated Oct.26, 2010.

Prosecution history of corresponding Japanese Patent Application No. 2006506158 including: Notification of Reason for Rejection dated Apr. 5, 2010; Notification of Reason for Rejection dated Jun. 27, 2011; Response dated Sep. 26, 2011; Response dated Feb. 14, 2011.

Prosecution history of corresponding Korean Patent Application No. 20057020375 including: Notice of Preliminary Rejection dated Jan. 2011; Notice of Preliminary Rejection dated Apr. 2011; Response dated Feb. 15, 2011.

Prosecution history of corresponding divisional Korean Patent Application No. 20117005397 including: Notice of Preliminary Rejection dated Apr. 2011.

International Search Report for PCT Application No. PCT/GB2004/001718 dated Jul. 15, 2004.

International Written Opinion for PCT Application No. PCT/GB2004/001718 dated Jul. 14, 2004.

Prosecution history of corresponding Singapore Application No. 200506702-0 including: Invitation to Respond to Written Opinion dated Jun. 14, 2007; Austrian Search Written Opinion dated Jun. 14, 2007; Response dated Nov. 27, 2007; Response dated Dec. 13, 2007; Invitation to Response to Written Opinion dated Nov. 14, 2008; Written Opinion dated Nov. 14, 2008; Response dated May 8, 2009; Examination Report dated Sep. 29, 2009.

Prosecution history of corresponding Singapore Application No. 201000155-0 including: Search Report dated Aug. 18. 2011; Invitation to Response to Written Opinion dated Sep. 12, 2011; Written Opinion dated Sep. 12, 2011; Response dated Feb. 15, 2012; Response to Written Opinion dated Sep. 21, 2011.

Prosecution history of corresponding Taiwanese Application No. 093111670 including: Office Action dated Aug. 28, 2012; Search Report dated Aug. 22, 2012; Response dated Nov. 2012.

* cited by examiner

APPARATUS AND METHOD FOR FORMING A PLASMA

FIELD OF THE INVENTION

The invention relates to plasma sources. In particular, the invention provides embodiments useful in plasma abatement systems, although the invention is not limited to such systems.

BACKGROUND OF THE INVENTION

A stable plasma requires certain physical conditions to exist. However, even when those conditions exist, a plasma may not spontaneously ignite. Examples of that phenomenon are well-known; for example, atmospheric arc welders require an 'RF start'. Another known plasma-ignition technique involves the induction of a 'spark' igniter using a Tesla coil. However, both of those techniques involve the use of metallic components in the plasma reaction chamber, which can be disadvantageous. In the case of microwave-pumped systems, such metal components are found to 'ground' the plasma and cause it to be unstable.

Other known methods used to ignite a plasma include reducing the pressure of the gas from which the plasma is to be formed and the introduction of argon, helium or some other gas or gases that are more easily ionised than the principal plasma gas.

It is particularly important to provide reliable ignition in a microwave plasma. In forming such a plasma, microwaves are generally provided by a magnetron and are transmitted along a waveguide to the plasma, where their energy is absorbed by the plasma, typically in a standing-wave arrangement. However, if the plasma is not ignited (i.e. if there is no plasma but only gas) then little energy is absorbed and, in the standing-wave arrangement, a significant amount of the incident energy is reflected back to the magnetron, which can severely shorten its lifetime. Such back-reflections may be reduced by including a one-way circulator or 'valve' in the microwave transmission line but such an arrangement adds to the cost of the device. A method of reliably igniting a microwave plasma is therefore desirable.

Plasma abatement has become a widely used method of eliminating exhaust gases from manufacturing processes, and is of particular application in the degradation of perhalogenated compounds especially perfluorinated compounds (PFCs).

PFCs are commonly used in the semiconductor manufacturing industry, for example, in dielectric film etching, and following the manufacturing process there is typically a residual PFC content in effluent gases. The PFCs are difficult to remove from the effluent. Their release into the environment is undesirable because they are known to have relatively high greenhouse activity. A variety of abatement methods have been used previously, for example, combustion, reactive adsorption and catalytic oxidation. The objective of abatement is to convert the PFC into one or more compounds that can be more conveniently disposed of, for example, by conventional scrubbing.

Plasma abatement has proved to be an effective method for degradation of PFCs to less damaging species. In the plasma abatement process, an effluent gas containing the species to be destroyed is caused to flow into a high density plasma and under the intensive conditions within the plasma the PFCs are subjected to impact with energetic electrons causing dissociation into reactive species which can combine with oxygen or hydrogen to produce relatively stable, low molecular weight by-products, for example, CO, $CO_2$ and HF, which can then be removed in a further treatment step.

In one form of previously known plasma abatement, the plasma is a microwave plasma. It is also known to use a radio-frequency plasma.

One form of device suitable for use in microwave plasma abatement is described in UK Patent Specification GB 2273027A. In that device, the microwave plasma is generated between two electrodes, which are in closely opposed relationship. The arrangement shown in GB 2273027A is self-starting. The arrangement of GB 2273027A suffers from a relatively high degree of corrosion of the electrodes by the reaction products.

US2002/0101162 describes a microwave plasma generator that is ignited by a spark from a Tesla coil.

BRIEF SUMMARY OF THE INVENTION

According to the present invention there is provided apparatus for forming a plasma for treating a gas, comprising means for generating, from a fluid different from the gas to be treated by the plasma, an ionised fluid stream for igniting the plasma, and a structure arranged to sustain the plasma.

Thus, the present invention also provides apparatus for treating an effluent gas stream from a semiconductor manufacturing process tool, the apparatus comprising means for generating an ionised fluid stream from a fluid different from the effluent gas stream, means for conveying the effluent gas stream to the ionised fluid stream to ignite a plasma, and means for applying electromagnetic radiation to the effluent gas stream to sustain the plasma.

The present invention also provides a method of forming a plasma for treating a gas, comprising generating, from a fluid different from the gas to be treated by the plasma, an ionised fluid stream for igniting the plasma, and supplying electromagnetic radiation to sustain the plasma.

The method may comprise generating the ionised fluid stream in a first location and transporting the stream to a second location where it ignites the plasma. The plasma is preferably generated in a chamber that is resonant at the frequency of the electromagnetic radiation. The plasma is preferably formed substantially at atmospheric pressure. The fluid is preferably of a different composition from the gas to be treated by the plasma. The ionised fluid stream is preferably a glow discharge.

The present invention further provides a method of treating an effluent gas stream from a semiconductor manufacturing process tool, the method comprising the steps of generating an ionised fluid stream from a fluid different from the effluent gas stream, applying the ionised fluid stream to the effluent gas stream to ignite a plasma, and supplying electromagnetic radiation to the effluent gas stream to sustain the plasma.

The effluent fluid stream may comprise a perfluorinated or hydrofluorocarbon compound, for example, one of CF4, C2F6, CHF3, C3F8, C4F8, NF3 and SF6.

BRIEF DESCRIPTION OF THE DRAWINGS

An illustrative embodiment of the invention will now be described in detail by way of example only with reference to the accompanying drawings, in which.

DETAILED DESCRIPTION OF THE INVENTION

Figure 1:
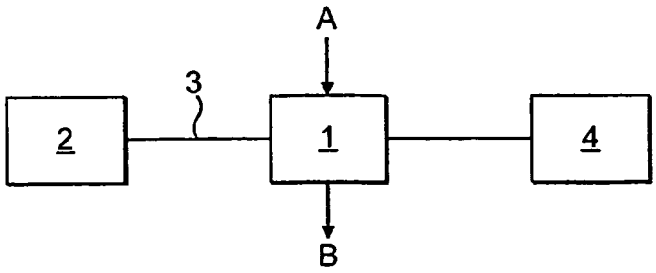
FIG. 1 is a flow diagram of an abatement system incorporating a microwave plasma reactor according to the invention.

With reference to FIG. 1, an abatement system includes a microwave plasma reactor 1 to which is connected a microwave supply 2, via waveguide 3, and a power supply 4. Gas to be treated, comprising exhaust gas containing perfluorocarbons and optionally an added inert gas, is fed to the reactor 1 as shown by arrow A. Treated gas, including decomposition products, leaves the reactor 1 as shown by arrow B and is subsequently subjected to treatment by, for example, scrubbing.

Figure 2:
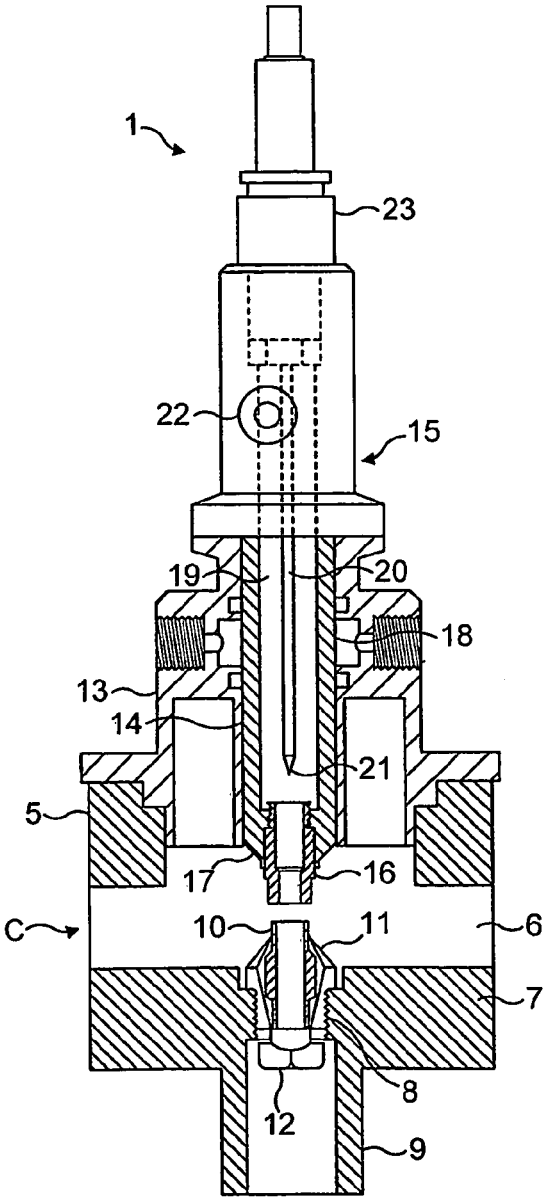
FIG. 2 is a vertical section through the reactor of FIG. 1.

With reference to FIG. 2, the reactor 1 has a conductive housing 5 inside which is located a cylindrical wall (not shown in the drawing) of a material that is transparent to microwaves defining a chamber 6. The conductive housing 5 is connected to waveguide 3 (not shown in FIG. 2) and has a bottom wall 7 in which there is an aperture 8 which communicates with an outlet tube 9 for the treated gas. Received in the aperture 8 is a first plasma-localising electrode 10 which consists of a tubular member having at its upper end a conducting flange 11 which locates the electrode 10 within a recess in the bottom wall 7. The electrode 10 is secured in position by a nut 12, which is screw-threadedly engageable upon the lower end of the electrode 10.

The upper part of housing 5 is closed by closure means 13 which defines a central bore 14 in which a cylindrical housing 18 is received. Second plasma-localising electrode 16 is received in an end 17 of the housing 18 and is arranged coaxially with electrode 16. Electrode assembly 16 is a hollow cylinder, which is arranged to be opposed to electrode 10, the electrodes 10 and 16 constituting a pair of plasma-localising electrodes.

Flange 24 of glow-discharge electrode assembly 15 mates with housing 18, such that glow-discharge electrode assembly 15 sits on housing 18. Assembly 15, housing 18 and electrode 16 define a second chamber 19 which communicates with chamber 6 through electrode 16. Concentrically arranged within housing 18 is a plasma-ignition, glow-discharge electrode 20, which is in the form of a high voltage electrode having a pointed end 21 pointing towards, but spaced from, electrodes 16 and 10. The ignition electrode forms an ionised fluid stream, which in this embodiment is in the form of a glow-discharge. In an upper region of the chamber 19 is an inlet 22 for a flow of glow-discharge gas. The inlet 22 is arranged tangentially with respect to the chamber 19 to promote formation of a helical flow path around electrode 20 generally downwardly towards electrode 16. Electrode assembly 15 is connected to a power supply via connector 23.

Figure 3:
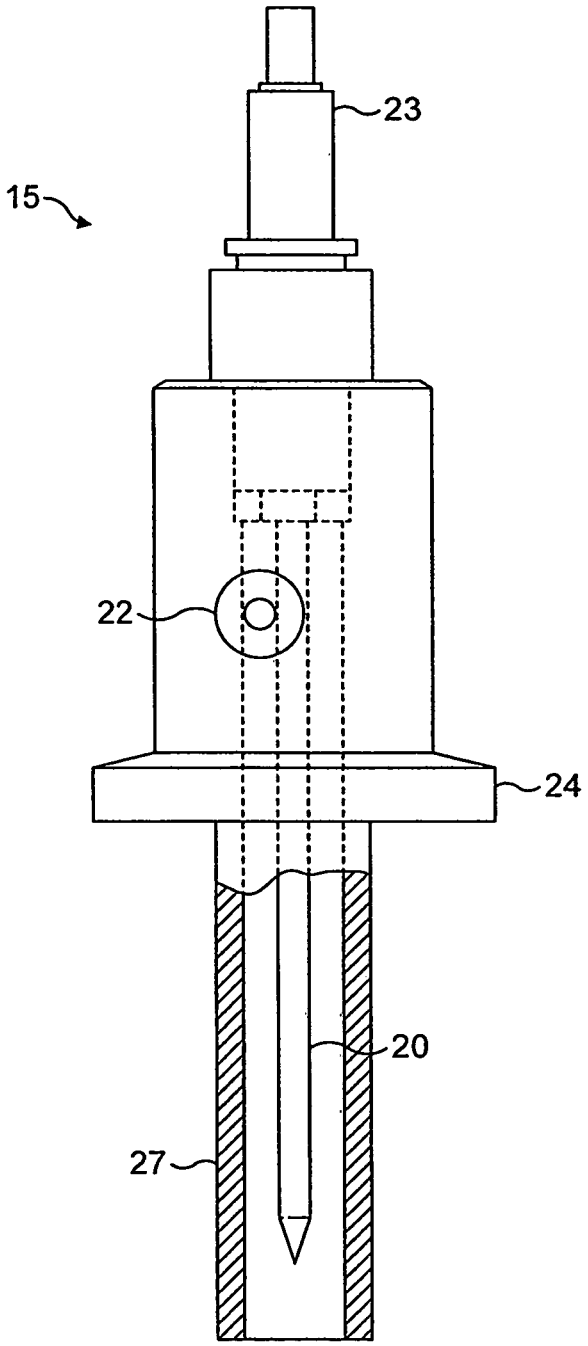
FIG. 3 is a vertical section through an glow-discharge ignition electrode assembly that is incorporated into the reactor of FIG. 2.

Assembly 15 is shown in more detail in FIG. 3, in which it includes a housing 27. Housing 27 is a cylindrical wall having an aperture at its lower end. In the arrangement of FIG. 2, housing 27 is replaced by housing 18, which forms part of the plasma reactor and includes reactor electrode 16, to which electrode 20 discharges. In other embodiments of the invention, assembly 15 is inserted into a prior-art reactor or other plasma-sustaining structure. In such cases, housing 27 may be required to channel the flow of discharge gas or to provide a surface to which electrode 20 may discharge.

During normal use of the reactor of FIG. 2, gas to be treated is pumped into chamber 6 via an inlet (not shown), passes between electrodes 10 and 16 and leaves chamber 6 through outlet tube 9.

Electromagnetic radiation of microwave frequency is input into chamber 6 from a magnetron via a waveguide, which abuts chamber 6 on a first side. On the opposite side of chamber 6, a continuation of the waveguide includes a movable end plate that is adjusted to cause the incident microwaves to form a standing wave. The plate is adjusted so that the standing wave forms with an antinode at electrodes 10 and 16. Such a method of delivering microwaves to a chamber is well known in the art.

Electrodes 10, 16 are at electrical ground. They are spaced apart by 5 mm. In normal use, electrodes 10, 16 serve to localise or confine a plasma formed from the gas to be treated. As the plasma is localised at the antinode of the microwave standing wave, power is efficiently coupled from the microwave field into the plasma.

Formation of a stable plasma in nitrogen (containing carbon tetrafluoride for processing) flowing at 20 litres per minute requires 1 kW to 2 kW of microwave power. However, the spacing of electrodes 10, 16 is too great for the gas to be ignited into a plasma by incident microwave power alone. Glow-discharge source 15 serves as a plasma torch, providing a glow discharge to ignite the plasma, as described below. Once ignited, the plasma is sustained by the electromagnetic conditions in housing 5 and particularly in the vicinity of electrodes 10, 16.

An inert, ionisable gas (in this example, nitrogen) flows through inlet 22 of assembly 15 into chamber 19. A glow-discharge is formed in this gas as follows.

A low-voltage, high-current source (in this example, capacitor 64 shown in FIG. 4) is permanently connected to electrode 20. However, when no conductive path to ground exists, no significant current can flow from this source. During ignition of the plasma, a high voltage is applied to the electrode 20 temporarily. The high voltage results in a corona discharge through the nitrogen gas from the end 21 of electrode 20 towards a proximal portion electrode 16. That corona discharge provides a path through which a large current from the low voltage source can flow to ground. Flow of the large current causes formation of a glow discharge in the nitrogen.

The glow discharge thus formed is caused by the gas flow to move from chamber 19 through electrode 16 into chamber 6. Microwaves (indicated by arrow C) received from source 2 are able to couple efficiently to the glow discharge and, in typically less than one second, the plasma ignites, leading to a stable microwave plasma which can be maintained by means of the microwave source and electrodes 10 and 16 after the power supply to electrode 20 is switched off (typically after about three seconds).

We have found that in order for the plasma to ignite, the instantaneous power of the glow discharge should be similar to the power required to sustain the plasma, i.e. in the range 1 kW to 2 KW for a flow rate of 20 litres per minute of nitrogen in chamber 6.

Thus the microwave plasma results from a gas discharge sustained by an electromagnetic field; the conditions for its maintenance are determined by the charged particle properties and energy loss mechanisms.

Figure 4:
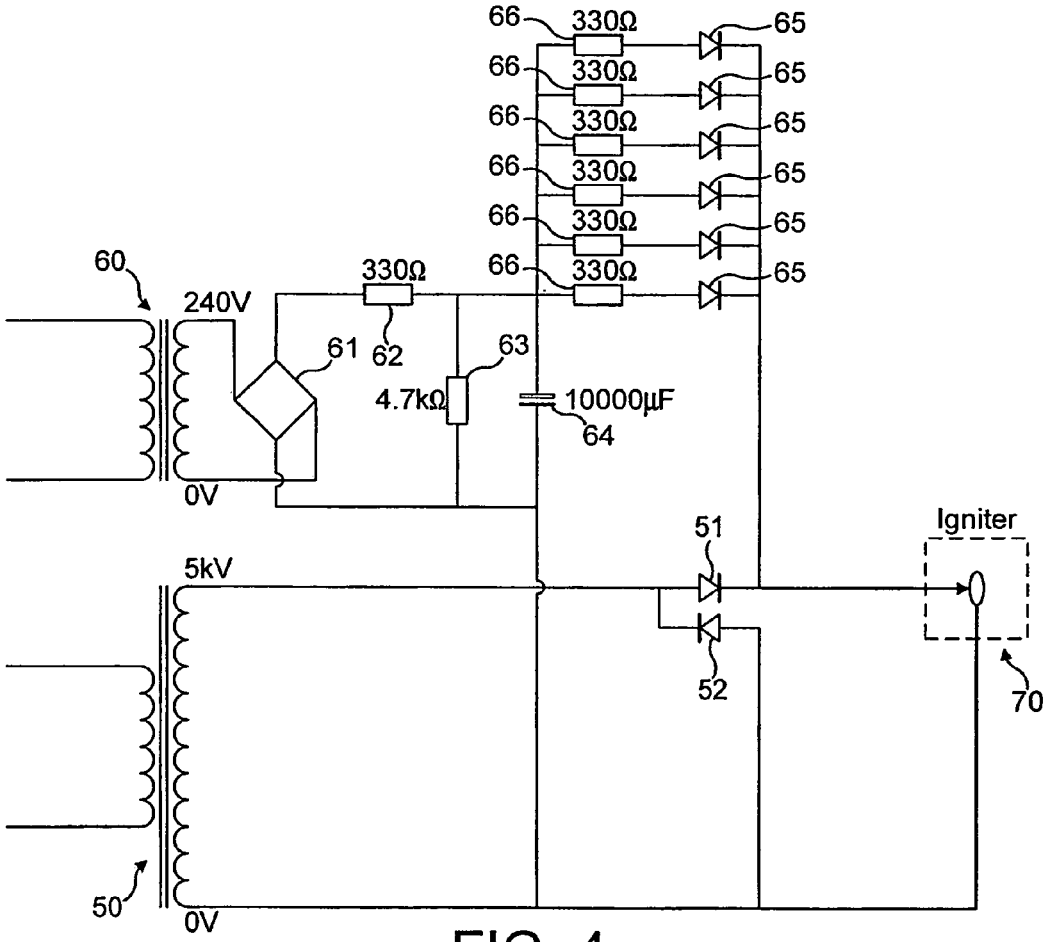
FIG. 4 is a circuit diagram for a circuit to be used with an ignition electrode of the reactor of FIG. 2.

A suitable capacitor discharge circuit for supplying a high voltage and a low-voltage DC current to electrode 20 is shown in FIG. 4.

High-voltage (5 kV) transformer 50 is connected to igniter 70 comprising electrode 20 and electrode 16. The connection to electrode 20 is via half-wave rectifier diode 51. Diode 52 provides a route for current to discharge during the part of the AC cycle of transformer 50 when the current is in the wrong direction for discharge through electrode 20.

Low-voltage (240 V) transformer 60 is also connected to igniter 70. The transformer 60 is connected to full-wave rectifier bridge 61 and to a 330Ω resistor 62 and a 4.7 kΩ resistor 63. Resistor 63 is connected in parallel with 10000 μF capacitor 64 and connected to electrode 20 via a bank of diodes 65, each associated with a protective 330Ω resistors 66. The 330Ω resistor 62 limits current draw from transformer 60 and bridge rectifier 61 during charging of capacitor 64. The 4.7 kΩ resistor 63 is a trickle discharge for capacitor 64. Resistor 63, capacitor 64 and diode 52 are each connected to the 0V terminal of transformer 50 and to electrode 16 of the igniter 70, all of which are at earth.

Prior to ignition, a large charge is built up on capacitor 64 as it is unable to discharge through igniter 70 as electrodes 20 and 16 are not connected. During ignition, high-voltage transformer 50 provides a 5 kV half-wave rectified AC voltage to electrode 20. The 5 kV voltage causes a low-current, corona discharge from electrode 20 to electrode 16, as discussed above. The corona discharge provides a conductive path between electrode 20 and electrode 16. Once that path is established by the high-voltage discharge, the low-voltage capacitor 64 is able to discharge to ground using the same path. A large current then flows from capacitor 64 and a glow discharge is formed in the gas to be treated.

In this example, plasma is present approximately 90% of the time, with ignition occurring every few days. However, provision of a reliable starting mechanism makes possible arrangements in which the plasma is ignited much more frequently, for example hourly.

In summary, apparatus is described for treating an effluent gas stream from a semiconductor manufacturing process tool. The apparatus comprises a plasma torch for generating a glow discharge from an inert, ionisable gas. The gas stream is conveyed to the glow discharge to ignite a plasma. A source of electromagnetic radiation applies electromagnetic radiation to the effluent gas stream to sustain the plasma. The apparatus is particularly suitable for treating perfluorinated and hydroflurocarbon compounds in the effluent gas stream.

Whilst the example embodiment described here relates to a plasma abatement reactor 1, it is envisaged that an element such as glow-discharge electrode assembly 15 (FIG. 3) could be used to provide a glow discharge to ignite a plasma in other systems having a plasma-sustaining structure, such as that defining chamber 6, in which it can be inserted and discharge. Alternatively, an auxiliary-plasma source may be integrated more closely within a structure arranged to sustain the primary plasma, rather than being a separate, insertable unit.

As indicated above, it is preferred for the plasma to be ignited by a glow discharge. However, any suitable ionised fluid stream may be used to ignite the plasma. For example, it may be possible to generate that ionised gas flow by a discharge other than a glow discharge, for example by a corona discharge or an arc discharge. At least some of the features described above in relation to glow-discharge-based apparatus may also be suitable for use in a system utilising another suitable ionised gas flow.

The inventors have demonstrated that provision of an ionised fluid stream, for example, a glow discharge source permits effective ignition of a plasma where the electric field conditions in the plasma-sustaining structure are such that the plasma cannot or cannot reliably self-start.

The apparatus may be comprised in a plasma abatement system.

As mentioned above, the plasma-sustaining structure may be arranged to utilise electromagnetic radiation in sustaining the plasma. Thus, the plasma-sustaining structure may comprise a source of the electromagnetic radiation or it may be suitable for connection to a source of the electromagnetic radiation. The electromagnetic radiation may be microwave or radio-frequency radiation; microwave and radio-frequency plasmas are of particular interest in plasma abatement systems, as discussed above. The radiation may for example have a frequency of around 580 kHz, 13.56 MHz, 27 MHz, 915 MHz or 2.45 GHz (prior-art devices operate around those frequencies). The plasma-sustaining structure may comprise a chamber that is resonant at the frequency of the electromagnetic radiation. Utilising a resonant cavity can result in formation of an electromagnetic standing wave, which provides localised enhancement of electromagnetic field strength, particularly in the vicinity of the antinode or antinodes of the standing wave.

The plasma-sustaining structure may comprise a chamber that is connectable to a flow of gas to be treated by the plasma.

The plasma-sustaining structure may comprise at least one plasma-localising electrode. By localising the plasma to a relatively constricted region in the plasma-sustaining structure, a pressure drop may be obtained that enables ignition and sustenance of the plasma to be achieved more readily. The plasma-locating electrode may be pointed; a pointed electrode enhances the electric field in its vicinity. The plasma-localising electrode may be arranged at or near an antinode of an electromagnetic standing wave. The plasma-sustaining structure may comprise two plasma-localising electrodes.

As mentioned above, in certain known plasma reactors, for example, that described in GB 2273027A, the plasma is localised between opposed electrodes. The plasma is sustained by virtue of the electric field between the electrodes, which comprises a component attributable to the incident electromagnetic waves and a component attributable to the plasma. In the previously known arrangement, it was considered advantageous to have the electrodes closely opposed, for example, at a separation of 0.1 to 0.5 mm. It has now been found that the plasma stability can be enhanced and the erosion of the electrodes by the corrosive by-products of the plasma reaction reduced by increasing the spacing between the electrodes. Thus, for example, in some embodiments the plasma-localising electrodes may comprise first and second electrodes opposed to one another and spaced from one another by a spacing of at least 1 mm, for example between 2 mm and 8 mm.

A consequence of increasing the spacing between the electrodes is that, for a given applied power, the strength of the field between the electrodes, is reduced. As a result, the conditions for reliable initial formation of the plasma may no longer exist.

The aforementioned apparatus offers the possibility of operation under conditions that are favourable in terms of plasma stability and reduction in corrosion whilst nonetheless providing effective ignition of the plasma, which would not otherwise be achievable or not be reliably achievable under those operating conditions. Another advantage is that, by removing the need for closely spaced electrodes, larger sources may be provided, capable of handling higher gas flow rates.

The plasma-localising electrode/s may be at electrical ground. The plasma and the incident electromagnetic radiation may thus be at a significantly different potential from the plasma-localising electrode (s).

The plasma-sustaining structure may be arranged to be substantially at atmospheric pressure during plasma formation. Significant simplification of apparatus may result when it is not necessary to keep the plasma-maintaining structure at a pressure other than atmospheric.

As previously mentioned, the ionised fluid stream is preferably a glow discharge. As is well known, a glow discharge is a luminous, thermal plasma. It is formed by applying to a gas a voltage that is greater than the breakdown voltage of that gas. Once a glow discharge has been achieved, the voltage required to sustain it is generally lower than the breakdown voltage. The source of the glow discharge may comprise a glow-discharge electrode for forming the glow-discharge. The glow-discharge source may comprise, or be suitable for connection to, a source of the glow-discharge gas (that is, a gas in which the glow-discharge is formed). The glow-discharge gas may be nitrogen or a noble gas or any other substantially inert and ionisable gas. The gas for forming the plasma may comprise for example an exhaust gas from a manufacturing process.

The glow-discharge electrode may be elongate. The glow-discharge source may comprise circuitry for providing a voltage sufficiently high to initiate the glow discharge and circuitry for providing sufficient current to sustain the glow discharge, preferably for at least 0.1 seconds. The glow-discharge source may be arranged to cease generation of the glow discharge after the plasma is ignited; thus the glow-discharge source may for example be arranged to generate a glow discharge for up to 10seconds or for example for up to 5 seconds, for example for from 1 to 5 seconds.

The glow-discharge electrode may be arranged to discharge to the plasma-sustaining structure, which may be at electrical ground.

The glow-discharge electrode may be so arranged that in use it is in the glow-discharge gas flow upstream of the plasma-sustaining structure, such that the glow-discharge is transported into the plasma-sustaining structure by the glow-discharge gas. A particular advantage of such an arrangement is that the glow-discharge electrode may thus be arranged away from regions of the apparatus that are very hot and potentially reactive. The lifetime of the electrode may be extended significantly by keeping it out of such regions.

The glow-discharge source may comprise a chamber of generally cylindrical shape comprising an inlet arranged to introduce the glow-discharge gas into the chamber substantially tangentially.

As indicated above, it is preferred for the plasma to be ignited by aglow discharge. However, any suitable ionised fluid stream may be used to ignite the plasma. In some embodiments, it may be possible to generate that ionised gas flow by a discharge other than a glow discharge, for example by a corona discharge or an arc discharge. At least some of the features described above in relation to glow-discharge-based apparatus may also be suitable for use in a system utilising another suitable ionised gas flow.

I claim:

1. An apparatus for forming a sustained plasma to treat a gas comprising:

a first chamber for receiving the gas;

a second chamber for receiving a fluid, and being in fluid connection with the first chamber;

means for generating an ionized fluid stream in the second chamber for igniting a plasma in the first chamber wherein the ionized fluid stream is generated from the fluid different than the gas to be treated, and wherein the means comprises a glow discharge electrode that is separated from the gas by the fluid and generates the ionized fluid stream using a glow discharge induced by an electrical potential; and a structure arranged to sustain the plasma.

2. The apparatus according to claim 1 wherein the plasma-sustaining structure is arranged to utilize electromagnetic radiation in sustaining the plasma.

3. The apparatus according to claim 2 wherein the plasma-sustaining structure comprises a source of the electromagnetic radiation.

4. The apparatus according to claim 2 wherein the plasma-sustaining structure is suitable for connection to a source of the electromagnetic radiation.

5. The apparatus according to claim 2 wherein the electromagnetic radiation is microwave or radio-frequency radiation.

6. The apparatus according to claim 2, wherein the plasma-sustaining structure is disposed in the first chamber that is resonant at the frequency of the electromagnetic radiation.

7. The apparatus according to claim 2 wherein the glow-discharge electrode is arranged to discharge to the plasma-sustaining structure.

8. The apparatus according to claim 2 wherein the glow-discharge electrode is so arranged that in use it is in the ionized fluid stream upstream of the plasma-sustaining structure, such that the glow discharge is transported into the plasma-sustaining structure by the ionized fluid stream.

9. The apparatus according to claim 1, wherein the plasma-sustaining structure comprises at least one plasma localizing electrode.

10. The apparatus according to claim 9 wherein the plasma-localizing electrode is arranged at or near an antinode of an electromagnetic standing wave.

11. The apparatus according to claim 9, wherein the plasma-sustaining structure comprises two plasma localizing electrodes.

12. The apparatus according to claim 11 wherein the plasma localizing electrodes comprise first and second electrodes opposed to one another and spaced from one another by a spacing of at least 1 mm.

13. The apparatus according to claim 12 wherein the spacing is between 2 and 8 mm.

14. The apparatus according to claim 9 wherein said at least one plasma localizing electrode is at electrical ground.

15. The apparatus according to claim 1 wherein the plasma-sustaining structure is arranged to be substantially at atmospheric pressure during plasma formation.

16. The apparatus according to claim 1 wherein the glow-discharge electrode is elongate.

17. The apparatus according to claim 1 wherein the means for generating an ionized fluid stream comprises circuitry for providing a voltage sufficiently high to initiate the glow discharge and circuitry for providing sufficient current to sustain the glow discharge for at least 0.1 seconds.

18. The apparatus according to claim 17 wherein the means for generating an ionized fluid stream is arranged to cease generation of the glow discharge after the plasma is ignited.

19. The apparatus according to claim 17 wherein the means for generating an ionized fluid stream is arranged to generate the glow discharge for up to 10 seconds.

20. The apparatus according to claim 19 wherein the means for generating the ionized fluid stream is arranged to generate the glow discharge for up to 5 seconds.

21. The apparatus according to claim 20 wherein the means for generating an ionized fluid stream is arranged to generate the glow discharge from 1 to 5 seconds.

22. The apparatus according to claim 1 wherein the means for generating the ionized fluid stream is disposed in the second chamber of generally cylindrical shape comprising an inlet arranged to introduce the fluid into the second chamber substantially tangentially.

23. A method of forming a plasma for treating a gas comprising generating an ionized fluid stream in a first chamber using a glow discharge induced by an electrical potential for igniting the plasma in a second chamber, wherein the ionized fluid stream is generated from a fluid different from the gas to be treated by the plasma, and wherein the ionized fluid stream is generated by a glow discharge electrode that is separated from the gas by the fluid; and supplying electromagnetic radiation to sustain the plasma.

24. The method according to claim 23 comprising generating the ionized fluid stream in the first chamber and transporting the ionized fluid stream to the second chamber where it ignites the plasma.

25. The method according to claim 23 wherein the electromagnetic radiation is microwave or radio-frequency radiation.

26. The method according to claim 23 wherein the plasma is generated in the second chamber that is resonant at the frequency of the electromagnetic radiation.

27. The method according to claim 23 wherein the plasma is formed substantially at atmospheric pressure.

28. The method according to claim 23 wherein the ionized fluid stream is a glow discharge.

29. A method of treating an effluent gas stream from a semiconductor manufacturing process tool, the method comprising the steps of generating an ionized fluid stream from a fluid different from the effluent gas stream in a second chamber using a glow discharge induced by an electrical potential passing a glow discharge electrode that is separated from the effluent gas by the fluid, applying the ionized fluid stream to the effluent gas stream to ignite a plasma in a first chamber, and supplying electromagnetic radiation to the effluent gas stream to sustain the plasma.

30. The method according to claim 29 wherein the effluent fluid stream comprises a perfluorinated or hydrofluorocarbon compound.

31. The method according to claim 30 wherein the compound comprises one of CF4, C2F6, CHF3, C3F8, C4F8, NF3 and SF6.

32. An apparatus for treating a gas with a plasma formed from a glow discharge fluid comprising:

a first chamber for receiving the gas;

a supply of microwave radiation connected to the first chamber;

a second chamber having an inlet for the glow discharge fluid, the second chamber in fluid communication with the first chamber, wherein the glow discharge fluid has a composition different from that of the gas; and a glow discharge electrode positioned in the second chamber and separated from the gas by the glow discharge fluid for generating an ionized fluid stream using a glow discharge induced by an electrical potential.

33. The apparatus of claim 32 further comprising a plasma localizing electrode positioned in the first chamber.

34. The apparatus of claim 32 further comprising a plurality of plasma localizing electrodes positioned in the first chamber.

35. The apparatus of claim 32 further comprising a waveguide.

* * * * *